United States Patent [19]

Taragos

[11] 4,372,867

[45] Feb. 8, 1983

[54] UPHOLSTERY CLEANING PAD AND METHOD OF MAKING THE SAME

[76] Inventor: Peter Taragos, 216 - 20th Ave., NE, Minneapolis, Minn. 55418

[21] Appl. No.: 153,746

[22] Filed: May 11, 1981

[51] Int. Cl.[3] ..... C11D 17/00; B08B 1/00

[52] U.S. Cl. ..... 252/91; 15/104.93; 15/114; 252/174

[58] Field of Search ..... 252/91, 94, 174; 428/96, 85; 15/40, 104.93, 104.94, 114, 226; 427/243, 244, 394

[56] References Cited

U.S. PATENT DOCUMENTS

| | | | |
|---|---|---|---|
| 3,788,999 | 1/1974 | Abler | 252/91 |
| 3,827,857 | 8/1974 | Boulus | 252/91 X |
| 4,154,695 | 5/1979 | McCrudden et al. | 252/94 X |

*Primary Examiner*—Thurman K. Page

*Attorney, Agent, or Firm*—Williamson, Bains, Moore & Hansen

[57] ABSTRACT

The method of making a novel upholstery pad includes the steps of preparing a colloidal suspension containing predetermined amounts of sodium lauryl sulfate, sodium perborate, a degreaser, and a biodegradable soap containing no phosphates. The upholstery pad, which is of multi-ply construction including a terry cloth ply and a velour ply, is immersed in the colloidal suspension at room temperature and is removed and allowed to slowly, partially dry over a predetermined period of time to a damp condition. The pad is then rapidly dried in a drying medium so that the cleaning pad is permeated with a dried cleaning compound that be readily activated by immersing the pad in water.

2 Claims, 1 Drawing Figure

UPHOLSTERY CLEANING PAD AND METHOD OF MAKING THE SAME

SUMMARY OF THE INVENTION

Figure 1:
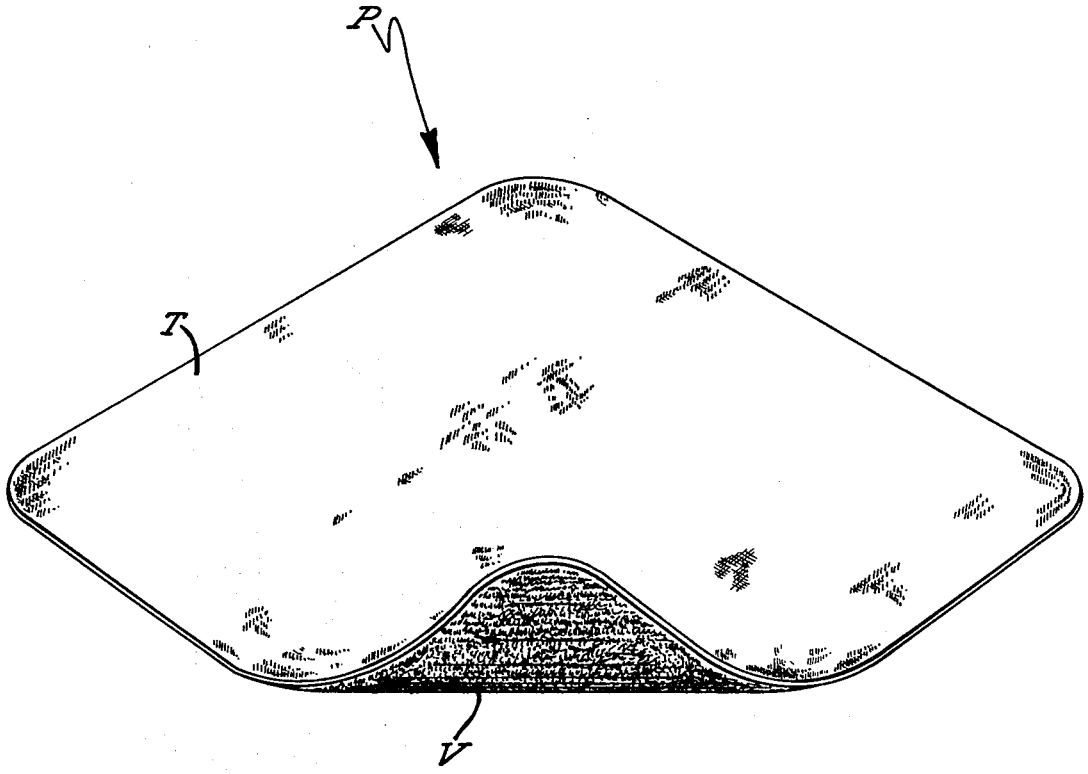

This invention relates to an upholstery cleaning pad and more particularly to an upholstery cleaning pad permeated with a dried cleaning compound.

An object of this invention is to provide a novel upholstery cleaning pad, and the method of making the same, which is permeated with a dried cleaning compound containing sodium lauryl sulfate.

A more specific object of this invention is to provide a novel multi-ply upholstery cleaning pad, and method of making the same, in which the pad including a terry cloth ply and a velour ply, is immersed in a colloidal suspension containing predetermined amounts of sodium lauryl sulphate, sodium perborate, a degreaser and a bio-degradable soap containing no phosphates is allowed to partially dry to a damp condition and is thereafter rapidly dried to a dry condition so that the cleaning pad is permeated with a dried cleaning compound. The cleaning compound may be readily activated within the pad by merely soaking the pad in water. With this arrangement, the cleaning pad may be used as an effective means of cleaning upholstery and the like.

FIGURE OF THE DRAWING

FIG. 1 of the drawing is a perspective view of the novel pad produced by my novel process.

PREFERRED EMBODIMENT OF THE INVENTION

There are a number of upholstery cleaning materials including various cleaning compounds, detergents and the like which are available to consumers. Usually the consumer must provide a sponge, cloth or other applicator for applying and also removing the cleaning compound from the upholstery. One of the problems many consumers experience in cleaning upholstery is the inability to apply the optimum amount of cleaning compound and/or water to the product to be cleaned. The over application of cleaning compound and water not only affects the overall cleaning results, but it is sometimes difficult to remove all of the soap or detergent from the upholstery. Similarly, the use of too little cleaning compound and water to the upholstery results in ineffective cleaning.

The present invention is directed to a novel method of making a novel upholstery cleaning pad in which the pad is permeated with the optimum amount of dried cleaning compound. In use, it is merely necessary to wet the pad before applying the pad to the upholstered surface.

The pad P itself is of multi-ply construction including a terry cloth ply T and a velour ply V. The terry cloth surface is used in applying the water activated compound to the surface to be cleaned and the velour surface is used in removing the soil and solution from the surface which is cleaned.

The principal active component of the cleaning compound is sodium lauryl sulfate which is highly effective as an upholstery cleaner. The sodium lauryl sulfate impregnates the fabric of the cleaning pad when the pad is soaked in a colloidal suspension containing sodium lauryl sulfate. However, it has been found that sodium lauryl sulfate when in a dried condition, will form an irritating powder when the user handles the pad prior to wetting. Therefore, a glazing agent is provided which coats the sodium lauryl sulfate and also enhances the cleaning capability of the sodium lauryl sulfate. To this end, it has been found that the pure soap, containing no phosphates may be added to the colloidal suspension and will coat the sodium lauryl sulfate upon drying and will prevent the formation of the irritant dust. Commercial non-phosphate soaps such as Ivory Snow may be used as a glazing agent.

The cleaning compound includes a bleaching agent, preferably sodium perborate, although other bleaching agents may also be used. The cleaning compound also includes a degreaser and any suitable degreasing compound compatible with the sodium lauryl sulfate may be used including a naptha compound containing talc, glycerin but no phosphates. A suitable commercial degreaser such as a degreaser sold under the trademark, Fels Naptha, may be used.

In carrying out the novel process, a colloidal suspension will be formed and the multi-ply upholstery cleaning pad will be soaked in the suspension so that the pad is completely permeated with the cleaning compound.

The colloidal suspension will include 7.2% by volume of a non-phosphate soap or 29% by volume of sodium lauryl sulfate, 3.6% by volume of a degreaser, and 0.3% of a bleaching agent in a predetermined volume of water. After soaking, the upholstery cleaning pad is allowed to dry and is sold in a dried condition.

In the following example, a two liter volume of the colloidal suspension was made, and several multi-ply upholstery cleaning pads were soaked in the solution and thereafter dried. Two hundred forty cc of a non-phosphate soap, was added to two liters of water and the water was heated to 100° C. to cause the soap to dissolve. The soap solution was allowed to stand for a few minutes and thereafter approximately 960 cc of sodium lauryl sulfate was added to the solution along with 8 cc of sodium perborate and 120 cc of a degreaser, preferably Fels Naptha soap. The mixture was thoroughly stirred and formed a colloidal suspension which was allowed to stand until it reached room temperature.

The multi-ply cleaning pads were then immersed in the suspension so that the pads completely absorb the cleaning material. The pads are preferably ten inches by thirteen inches (10"×13") in size and are preferably uncolored. The non-phosphate soap coats the sodium lauryl sulfate whereby upon drying the sodium lauryl sulfate will not form irritant dust if the pads are roughly handled prior to wetting. Pads are removed from the colloidal suspension and allowed to slowly dry for a period of approximately ten hours. The pads are in the damp-dry condition after this preliminary drying step, and, are thereafter placed in a drying medium, preferably a dryer and are rapidly dried for approximately one-half hour in a tumble drying operation. This rapid drying process not only dries the pads to a dried condition but also removes lint, grains and the like from the pads. The pads may then be packaged for commercial exploitation.

When a user use the pads, the pads are first soaked in water which immediately activates the cleaning compound. However, it is preferred that the pads be crumpled into a ball-like condition prior to soaking the pad in water. The terry cloth surface is applied to the upholstery to be cleaned in a rotary type motion. The terry cloth surface functions as a brush and the soiled area will be cleaned by the cleaning compound. The pad may then be soaked in a solvent, such as vinegar to remove the cleaning compound therefrom and the velour surface then applied to the cleaning upholstery to remove the excess cleaning compound, the entrained dirt, grease and the like.

What is claimed is:

1. A process of making an upholstery cleaning pad comprising steps of dissolving a predetermined amount of biodegradable soap containing no phosphates in a predetermined volume of boiling water, adding predetermined amounts of sodium lauryl sulfate, sodium perborate and a degreaser to said soap solution to thereby form a colloidal suspension, and thereafter allowing said suspension to cool to room temperature, immersing a fabric pad having a terry cloth ply and a velour ply in said suspension to thoroughly soak the pad with the suspension, removing said fabric pad from the suspension and allowing the pad to slowly partially dry over a predetermined period of time to a damp condition, and thereafter rapidly drying the pad to a dry condition in a drying medium.

2. A multi-ply upholstery cleaning pad formed of a fabric having a terry cloth ply and a velour ply, said pad having been immersed in a collodial suspension containing predetermination amounts of sodium lauryl sulfate, sodium perborate, the suspension being maintained at room temperature during the time the fabric pad is immersed therein, the fabric pad being allowed to slowly partially dry to a damp condition and thereafter rapidly drying the pad to a dry condition, whereby the cleaning pad is permeated with a dried cleaning compounds.

* * * * *